US011701596B2

(12) United States Patent
Derman et al.

(10) Patent No.: US 11,701,596 B2
(45) Date of Patent: Jul. 18, 2023

(54) WEARABLE RING WITH ACTION ACTIVATED TOY FIGURE

(71) Applicant: Jakks Pacific Inc., Santa Monica, CA (US)

(72) Inventors: Scott Hart Derman, Sherman Oaks, CA (US); Erich William Weidetz, Sherman Oaks, CA (US); James Groman, Westlake, OH (US)

(73) Assignee: JAKKS PACIFIC INC., Santa Monica, CA (US)

( * ) Notice: Subject to any disclaimer, the term of this patent is extended or adjusted under 35 U.S.C. 154(b) by 0 days.

(21) Appl. No.: 17/394,271

(22) Filed: Aug. 4, 2021

(65) Prior Publication Data

US 2022/0241697 A1 Aug. 4, 2022

Related U.S. Application Data

(60) Provisional application No. 63/144,791, filed on Feb. 2, 2021.

(51) Int. Cl.

| | |
|---|---|
| ***A63H 3/20*** | (2006.01) |
| ***A63H 13/06*** | (2006.01) |
| ***A44C 9/00*** | (2006.01) |
| ***A63H 3/50*** | (2006.01) |

(52) U.S. Cl.

CPC ..... *A63H 13/06* (2013.01); *A44C 9/0053* (2013.01); *A63H 3/20* (2013.01); *A63H 3/50* (2013.01)

(58) Field of Classification Search

CPC ..... A63H 3/20; A63H 13/00; A63H 13/06; A63H 33/003

See application file for complete search history.

(56) References Cited

U.S. PATENT DOCUMENTS

| | | | | |
|---|---|---|---|---|
| 3,613,301 | A | 10/1971 | Noble et al. | |
| 4,992,070 | A | 2/1991 | Mullen | |
| 5,385,573 | A | 1/1995 | Wright | |
| 5,433,643 | A | 7/1995 | Pratt | |
| 5,626,503 | A | 5/1997 | Hettel | |
| 5,842,562 | A | 12/1998 | Bauman | |
| 6,086,446 | A * | 7/2000 | Arriola | A63H 17/006 446/72 |
| 6,422,871 | B2 | 7/2002 | Shepherd | |
| 6,638,133 | B1 | 10/2003 | Brancolino | |
| 6,712,210 | B1 | 3/2004 | Sabath | |
| 6,824,112 | B2 | 11/2004 | Lange | |
| 7,306,096 | B2 | 12/2007 | d'Auriac | |
| 7,575,496 | B2 * | 8/2009 | Lau | A63H 3/20 446/4 |
| 7,627,935 | B1 | 12/2009 | Ostrum | |
| 8,881,437 | B1 | 11/2014 | McGrath | |
| 9,205,341 | B2 * | 12/2015 | Higuchi | A63H 3/46 |

(Continued)

*Primary Examiner* — John A Ricci

(74) *Attorney, Agent, or Firm* — Tope-McKay & Associates

(57) ABSTRACT

Described is a toy figure with activated components that are activated by wearable accessories. For example, a wearable ring can be positioned onto a toy figure as a mask or helmet, such that upon positioning the wearable ring upon the toy figure, the toy figure is activated to perform a function. The function is an action, such as causing the toy figure to reveal or expose a toy weapon (e.g., sword, gun, etc.), thereby allowing a user to engage in a variety of game play.

20 Claims, 8 Drawing Sheets

STAGE 1

STAGE 2

(56) References Cited

U.S. PATENT DOCUMENTS

| | | | | |
|---|---|---|---|---|
| 9,345,978 | B1 * | 5/2016 | Victor | A63H 3/48 |
| 9,649,570 | B2 | 5/2017 | Karsten | |
| 10,035,076 | B2 * | 7/2018 | Yu | A63H 17/008 |
| 2002/0127943 | A1 | 9/2002 | Gordon | |
| 2004/0121702 | A1 | 6/2004 | Seibert | |
| 2004/0253900 | A1 | 12/2004 | Treibitz | |
| 2006/0270310 | A1 | 11/2006 | Campbell et al. | |
| 2008/0090490 | A1 | 4/2008 | Barrows | |
| 2009/0015000 | A1 | 1/2009 | Wolfe | |
| 2009/0191783 | A1 | 7/2009 | Spitzer | |
| 2009/0270010 | A1 | 10/2009 | Scott | |
| 2010/0197190 | A1 | 8/2010 | Lloyd | |
| 2010/0304636 | A1 | 12/2010 | Seiz | |
| 2010/0317252 | A1 | 12/2010 | Raimondi | |
| 2011/0159775 | A1 | 6/2011 | Jean-Baptiste | |
| 2011/0312242 | A1 | 12/2011 | Muller | |
| 2012/0322338 | A1 | 12/2012 | Gilbert | |
| 2013/0040530 | A1 | 2/2013 | Matsuno | |
| 2015/0044936 | A1 | 2/2015 | Lofthouse | |
| 2016/0199264 | A1 | 7/2016 | McClintock | |

* cited by examiner

WEARABLE RING WITH ACTION ACTIVATED TOY FIGURE

CROSS-REFERENCE TO RELATED APPLICATIONS

This is a non-provisional application of U.S. Provisional Application No. 63/144,791, filed on Feb. 2, 2021, the entirety of which is incorporated herein by reference.

BACKGROUND OF THE INVENTION

(1) Field of Invention

The present invention relates to a toy figure with activated components and, more specifically, to a wearable ring that can be positioned onto a toy figure as a mask or helmet, such that upon positioning the wearable ring upon the toy figure, the toy figure is activated to perform a function.

(2) Description of Related Art

Toy figures or figurines have long been known in the art. However, nothing heretofore devised has provided an activatable toy figure that is activated by a helmet or mask that doubles as a wearable ring.

Thus, a continuing need exists for a new and improved toy figure.

SUMMARY OF INVENTION

The present disclosure provides an action activated toy figure. The toy figure is formed to have a first activation mechanism with a first trigger that, when activated, causes the first activation mechanism to perform a first action. Additionally, a first user wearable accessory is included that has keyed markings which are keyed to engage with and activate the first trigger.

In another aspect, the first activation mechanism includes a first spring-loaded feature that is formed to transition from a first stage to an expanded second stage upon activation of the first activation mechanism.

In yet another aspect, the toy figure further comprises a second activation mechanism, the second activation mechanism having a second trigger that, when activated, causes the second activation mechanism to perform a second action.

Additionally, a second user wearable accessory is included. The second user wearable accessory is distinctly keyed to engage with and activate the second trigger and corresponding second activation mechanism while avoiding activation of the first activation mechanism.

In yet another aspect, the second activation mechanism includes a second spring-loaded feature that is formed to transition from a first stage to an expanded second stage upon activation of the second activation mechanism.

Further, each of the first and second user wearable accessories are distinct wearable rings.

In another aspect, each of the first and second user wearable accessories are formed to be positioned onto the toy figure as a helmet or mask to at least partially conceal a head of the toy figure, such that upon positioning one of the first or second user wearable accessories onto the toy figure, the keyed marking engages with the corresponding first or second trigger.

Additionally, each of the first and second actions include causing the toy figure to reveal a first and second toy weapons, respectively.

In yet another aspect, each of the first and second toy weapons have distinct numerical markings thereon that are used for gameplay when two toy figures are "battling" one another.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a toy figure with activated components and, more specifically, to a wearable ring that can be positioned onto a toy figure as a mask or helmet, such that upon positioning the wearable ring upon the toy figure, the toy figure is activated to perform a function. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1A:
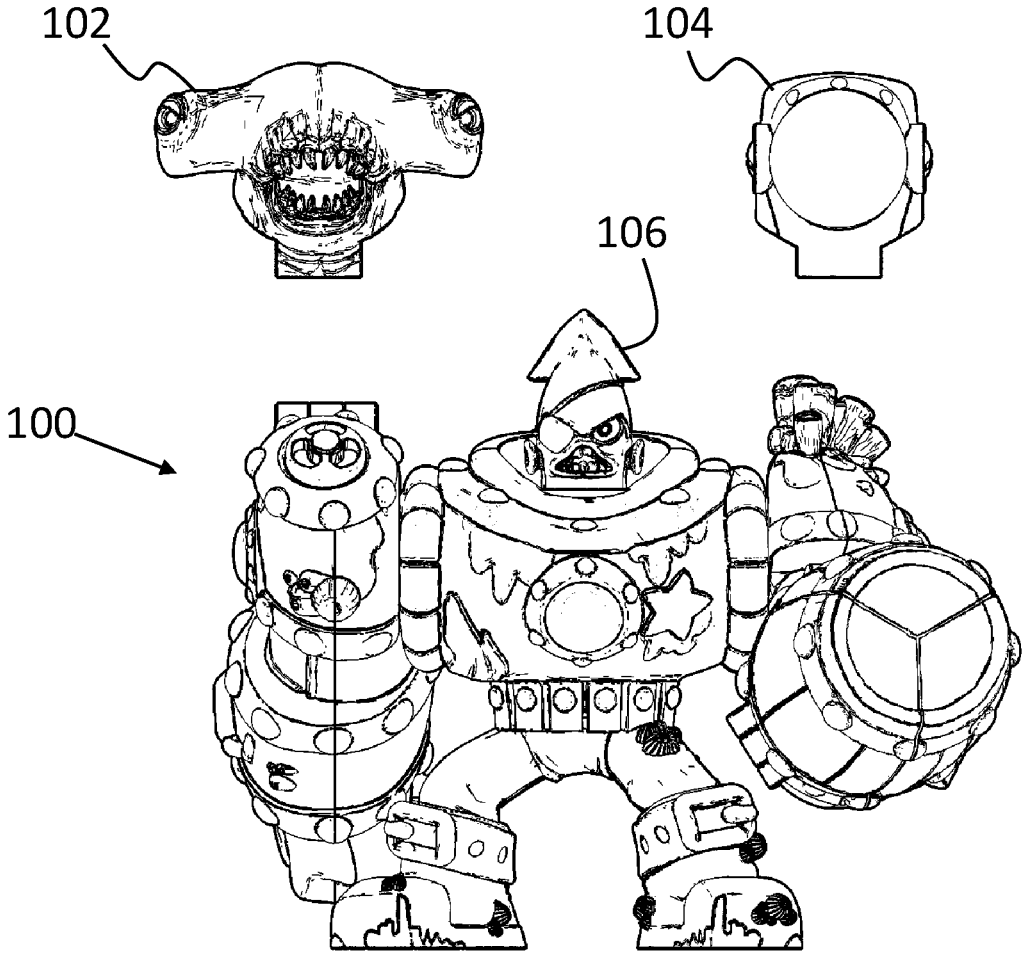
FIG. 1A is a front-view illustration of a toy figure and associated wearable rings according to various embodiments of the present invention.
Figure 1B:
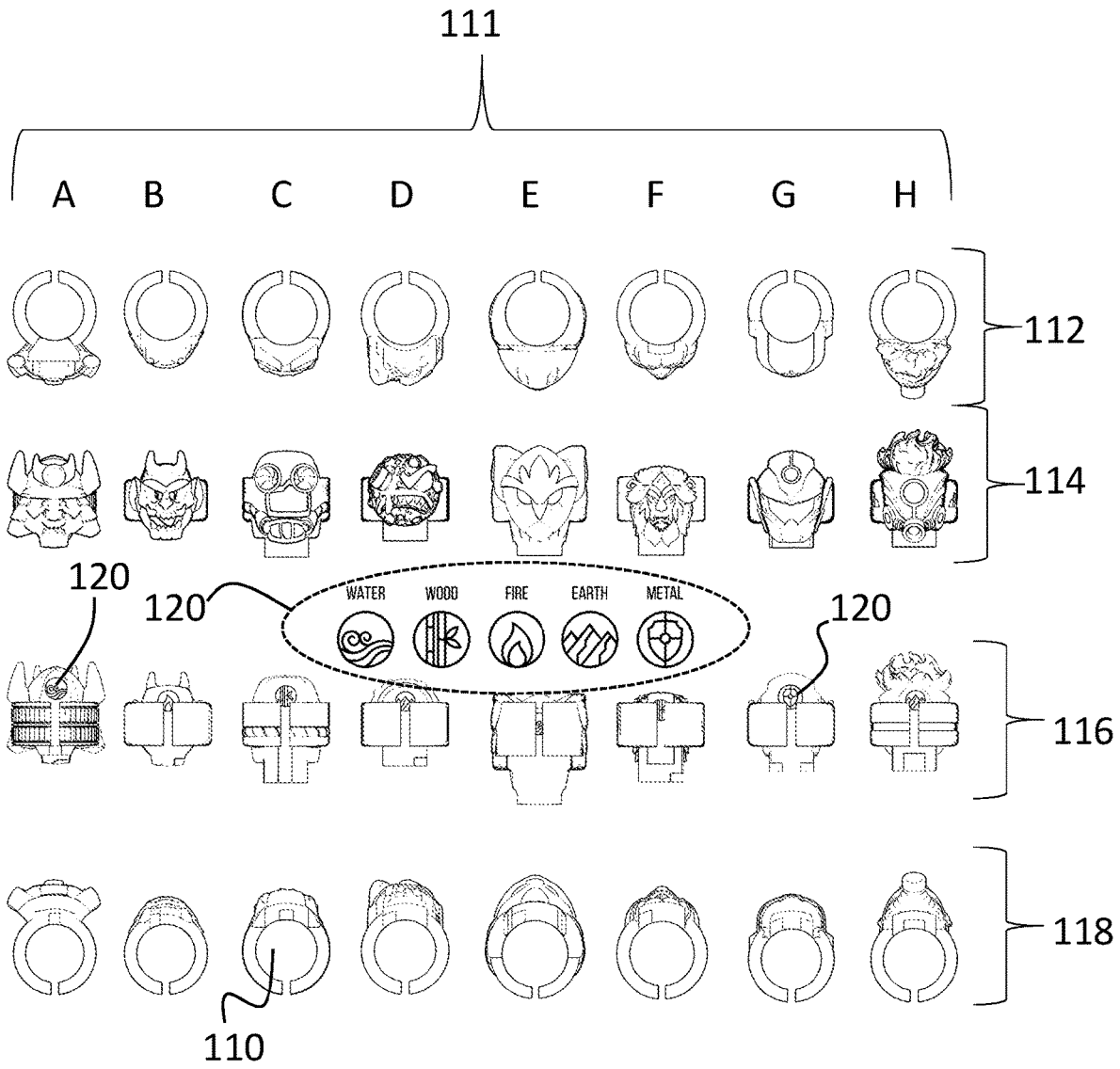
FIG. 1B is an illustration depicting example rings that are operable as wearable accessories in accordance with various embodiments of the present invention.

As noted above and as shown in FIG. 1A, the present disclosure is directed to a toy figure 100 with action activatable components. Notably, the toy figure 100 is accompanied by one or more user wearable accessories (e.g., first and second wearable rings 102 and 104). The user wearable accessories are formed to be used or otherwise worn by a user. Notably, the user wearable accessories are formed and keyed to connect with the toy figure 100 and activate an activation mechanism to cause the toy figure 100 to perform an associated action. As non-limiting examples and as depicted in FIG. 1B, the user wearable accessories can be formed as distinct rings 111 with corresponding finger holes 110 that can be worn by a user and then selectively positioned onto the figure as a mask or helmet, or backpack, etc., to activate a feature of the toy figure 100. Specifically, FIG. 1B depicts a plurality of example ring designs, including top 112, front 114, rear 116, and bottom 118 views. As described herein, the rings are formed to attach with the toy figure 100 and have keyed markings that are keyed to engage with and activate triggers on the toy figure. These aspects are described in further detail below. Other non-limiting examples of wearable accessories include necklace charms, earrings, etc., so long as the accessories are formed and keyed to connect with the toy figure and activate an activation mechanism.

Figure 2A:
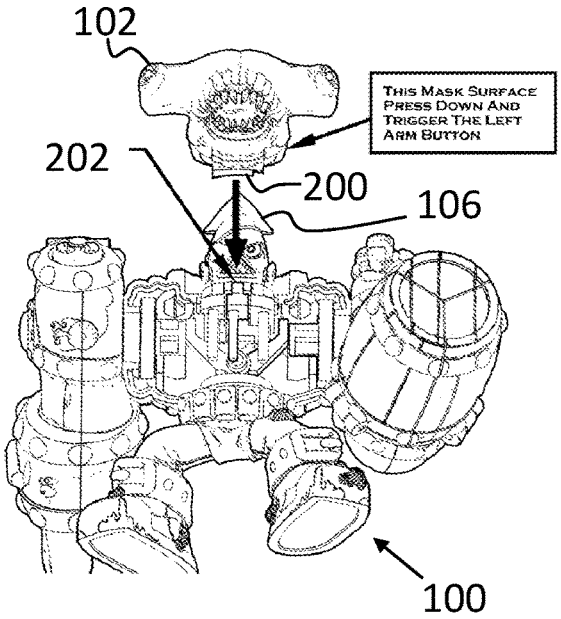
FIG. 2A is a front-view illustration of the toy figure and the associated first wearable ring.
Figure 2B:
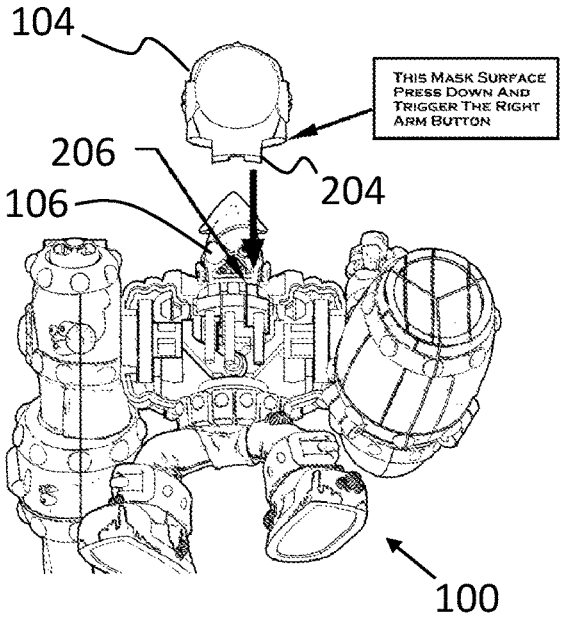
FIG. 2B is a front-view illustration of the toy figure and the second associated wearable ring.
Figure 3A:
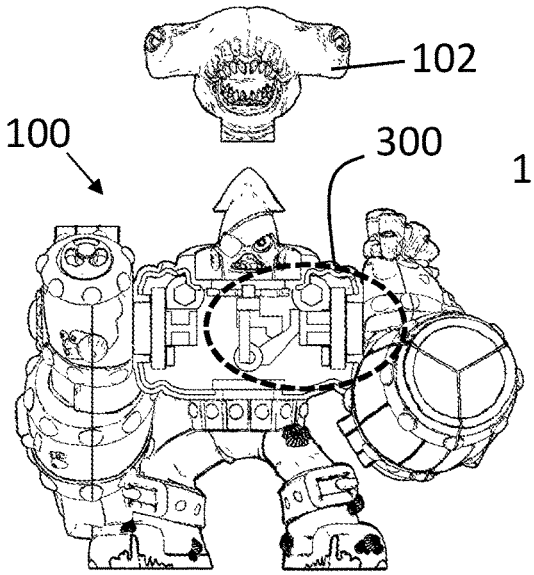
FIG. 3A is a front, interior-view illustration of the toy figure and the first wearable ring.
Figure 3B:
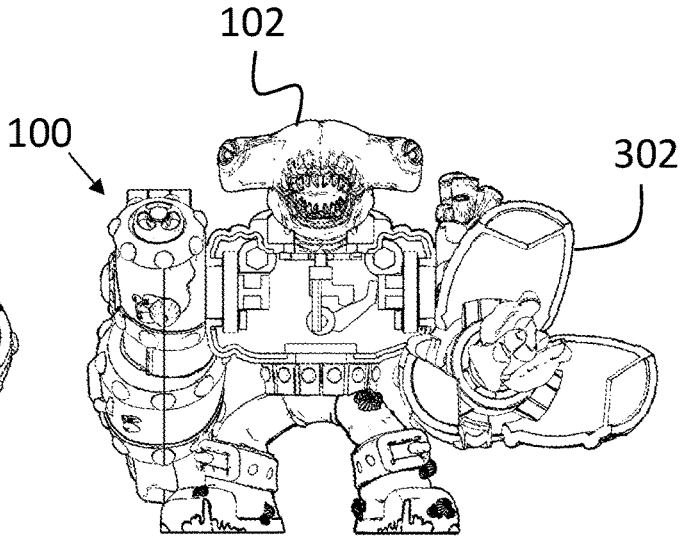
FIG. 3B is a front, interior-view illustration of the toy figure and the first wearable ring, depicting the first wearable ring as positioned onto the toy figure to activate a first action.

As noted above and referring again to FIG. 1A, the user wearable accessory is formed to attach with the toy figure 100. Thus, in one aspect, the wearable accessory (wearable by a child or user) can be attached/detached with the toy figure 100 at any suitable location as designed (such as a wearable ring 102 or 102 that can also operate as a helmet or mask, or shield or armor, etc.). In other words and as a non-limiting example, the ring 102 and 104 can be turned onto its side and slipped over the head 106 of the toy figure 100 to operate as a mask or helmet. In other aspects, the wearable ring can also simply be a component that can selectively attach/detach with the toy figure. In either case and as shown in FIGS. 2A and 2B, each wearable accessory (e.g., first and second rings 102 and 104) has a keyed marking that engages with a similarly keyed button on the toy figure 100 to activate a function of the toy figure 100. For example and as shown in FIG. 2A, the first wearable ring 102 has a first keyed marking 200 that is formed to depress a first button 202 when the ring 102 is positioned over the head 106 of the toy figure 100. In this case, the first button 202 is a left arm button that is connected with a first activation mechanism to cause the toy figure 100 to perform a first action, such as expanding features on the left arm. For example, the first activation mechanism can be a spring-loaded mechanism that is triggered by depression of the first button 202.

Alternatively and as shown in FIG. 2B, the second wearable ring 104 has a second keyed marking 204 that is formed to depress a second button 206 when the ring 104 is positioned over the head 106 of the toy figure 100. In this case, the second button 206 is a right arm button that is connected with a second activation mechanism to cause the toy figure 100 to perform a second action, such as expanding features, or shooting an item, etc., from the right arm. For example, the second activation mechanism can be a spring-loaded mechanism that is triggered by depression of the second button 206.

Thus, in some aspects, the first and second activation mechanisms are spring loaded and locked features, which get activated when the keyed markings 200 and 204 of the wearable ring 102 and 104 depress the relevant triggers (i.e., buttons 202 and 206 on the toy figure 100. The spring loaded and locked activation mechanisms can then be set again by a user, to be triggered and released again when the wearable ring 102 or 104 (and its markings 200 or 204) engage with the triggers (i.e., buttons 202 or 206) on the toy figure 100.

The toy figures 100 themselves are formed with the activation mechanisms. The activation mechanisms include all the relevant components to allow for triggerable functions or actions that are activated by the keyed markings 200 or 204 engaging with the relevant triggers (i.e., buttons 202 and 206) on the toy figures 100. For example, the toy figures 100 include spring-loaded and activated functions, such as a spring-loaded sword that can be slid and locked into a cavity or sheath (e.g., within the toy figures arms). In this example, depressing the trigger by the markings 200 or 204 on the mask causes a latch to release the spring-loaded sword, allowing the sword to project out from the arm or sheath, etc. Other examples include rotatable elements, such as rotatable blades, etc., which use rotatable elements within the activation mechanism to translation engagement of the keyed marking into a rotatable action. Thus, the toy figures include hinges, latches, springs, slides, etc. as may be necessary to provide any desired activated function that can be activated by positioning the ring or other item onto the toy figure 100. Several non-limiting examples are provided with the figures submitted herewith. Thus, submitted herewith are several illustrations depicting example wearable rings and toy figures according to embodiments of the present invention. It should be understood that the invention of the present disclosure is not limited to a wearable ring nor the specific actions as described and illustrated, as the concept of a wearable item that can be attached with a toy figure to cause the toy figure to perform the selected action can be expanded to any desired action or attachable item. Nevertheless, non-limiting examples of specific activation mechanisms are depicted in FIGS. 3A through 7B.

The first activation mechanism is depicted in FIGS. 3A through 5B. As noted above, the toy figure 100 is formed to include any suitable activation mechanism that is activated to perform an action upon selective engagement with markings on the user wearable accessory. In this example, the first activation mechanism 300 is positioned within the toy figure 100 and operably transitions between a first stage (show in FIG. 3A) and a second stage (shown in FIG. 3B). Note that the second activation mechanism is removed from the illustration to avoid obstructing imagery of the first activation mechanism 300. Positioning the first ring 102 upon the toy figure 100 causes the figure 100 to transition from the first stage to the second stage, where the first action is performed (i.e., spring-loaded expanding features 302 on the left arm).

Figure 4A:
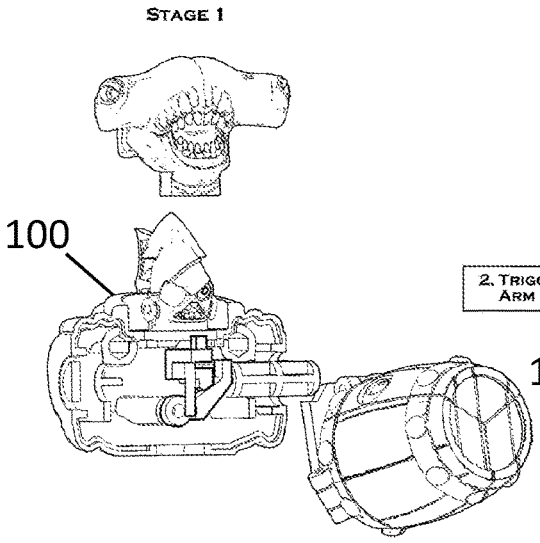
FIG. 4A is a front, isometric, interior-view illustration of the toy figure, depicting an interior view of a helmet activated activation mechanism for the first action.
Figure 4B:
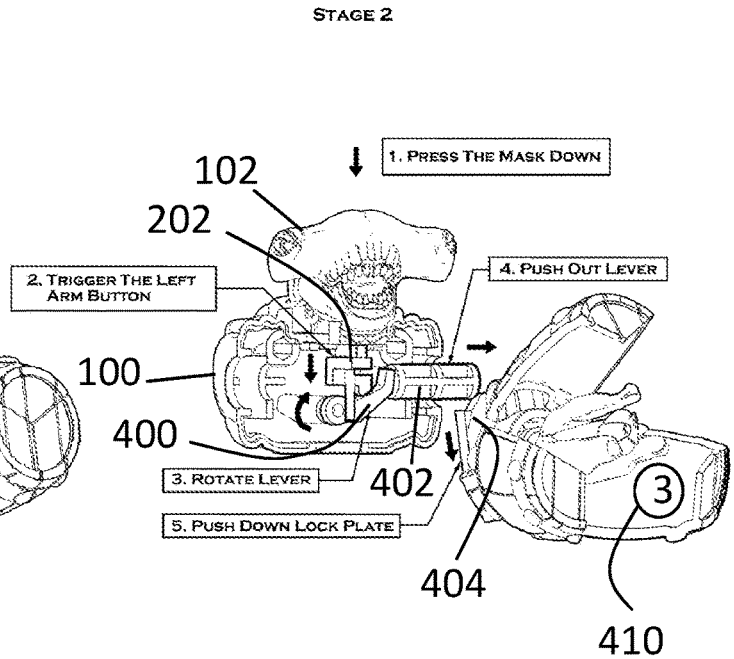
FIG. 4B is a front, isometric, interior-view illustration of the toy figure, depicting activation of the helmet activated activation mechanism using the first wearable ring.
Figure 5A:
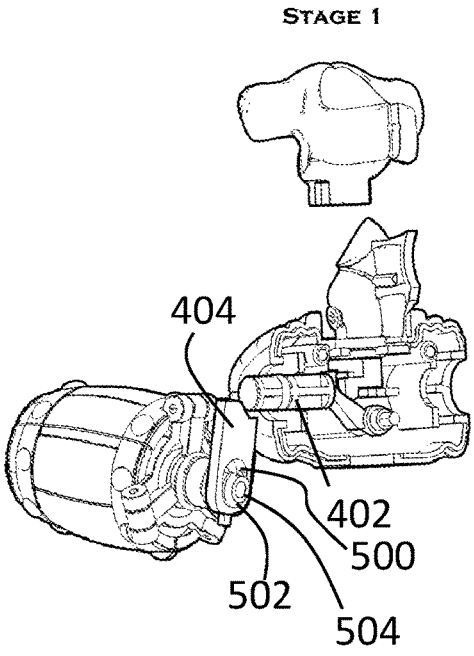
FIG. 5A is a rear, isometric, interior-view illustration of the toy figure, depicting an interior view of a helmet activated activation mechanism for the first action.
Figure 5B:
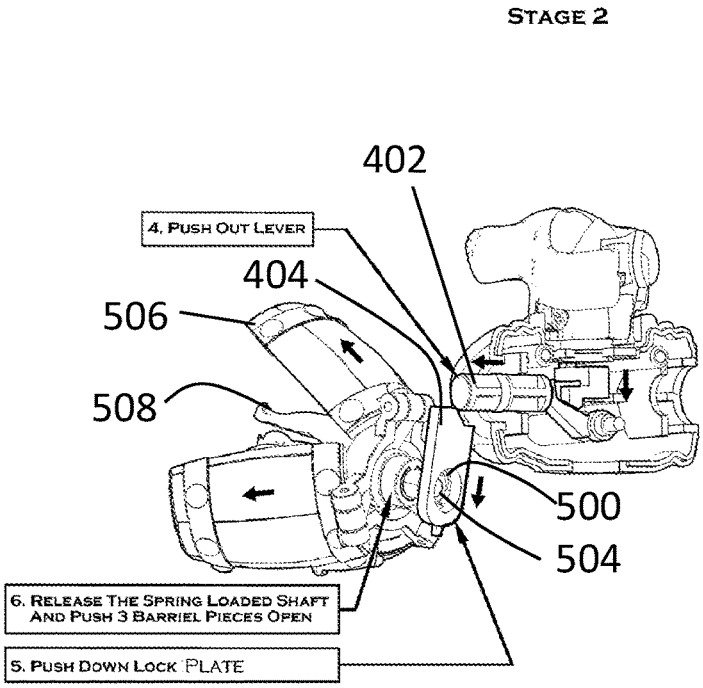
FIG. 5B is a rear, isometric, interior-view illustration of the toy figure, depicting activation of the helmet activated activation mechanism using the first wearable ring.
Figure 6A:
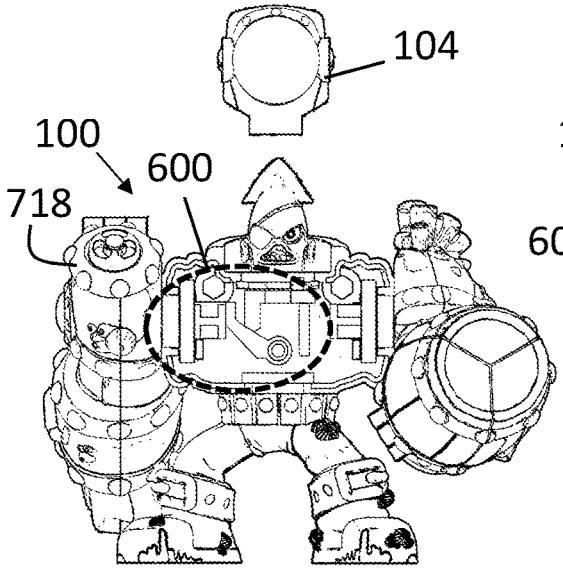
FIG. 6A is a front, interior-view illustration of the toy figure and the second wearable ring.
Figure 6B:
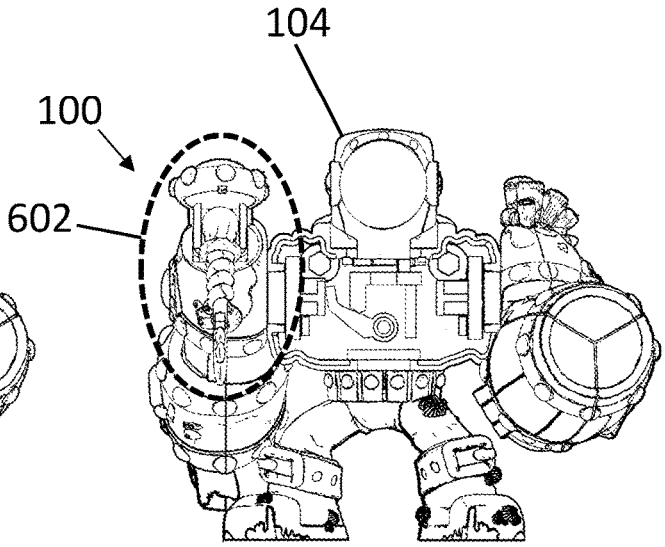
FIG. 6B is a front, interior-view illustration of the toy figure and the second wearable ring, depicting the second wearable ring as positioned onto the toy figure to activate a second action.

As shown in FIGS. 4A through 5B, the activation mechanism includes any desired components to perform the first action, including levers, plates, etc. In transitioning from stage 1 to stage 2, the first ring 102 is positioned upon the figure 100 as a mask. The mask is first pressed down, which causes the markings on the mask to engage with the activation mechanism. In this example, the mask depresses the first button (i.e., left arm button), which essentially triggers the left arm button 202. Pivotally connected with the toy figure is a rotate lever 400. Pressing down the left arm button 202 cause the left arm button 202 to engage with and rotate outward the rotate lever 400. Slidably positioned within the toy figure is a push out lever 402, which is pushed out by rotation of the rotate lever 400. Pushing out the push out lever 402 causes the push out lever 402 to engage with a push down lock plate 404 which, when pushed down, engages with and releases a spring-loaded shaft to perform the first action. These actions are further illustrated in FIGS. 5A and 5B. As shown between FIGS. 5A and 5B, the push out lever 402 pushes down the push down lock plate 404. As shown in FIG. 5A, the push down lock plate 404 has an aperture 500 passing through that is shaped to lock a protrusion 502 on an end of the spring-loaded shaft 504 when the first action is in stage one (as shown in FIG. 5A). When the push down lock plate 404 is pushed down (as shown in FIG. 5B), the spring-loaded shaft 504 is released through the aperture 500 and lock plate 404. As the spring-loaded shaft 504 is released outward, it engages with and forces the pivotally connected casings 506 (e.g., three barrel pieces) apart to expose the toy weapon 508 or other item concealed within the casings 506 during stage one.

Figures 7A, 7B:
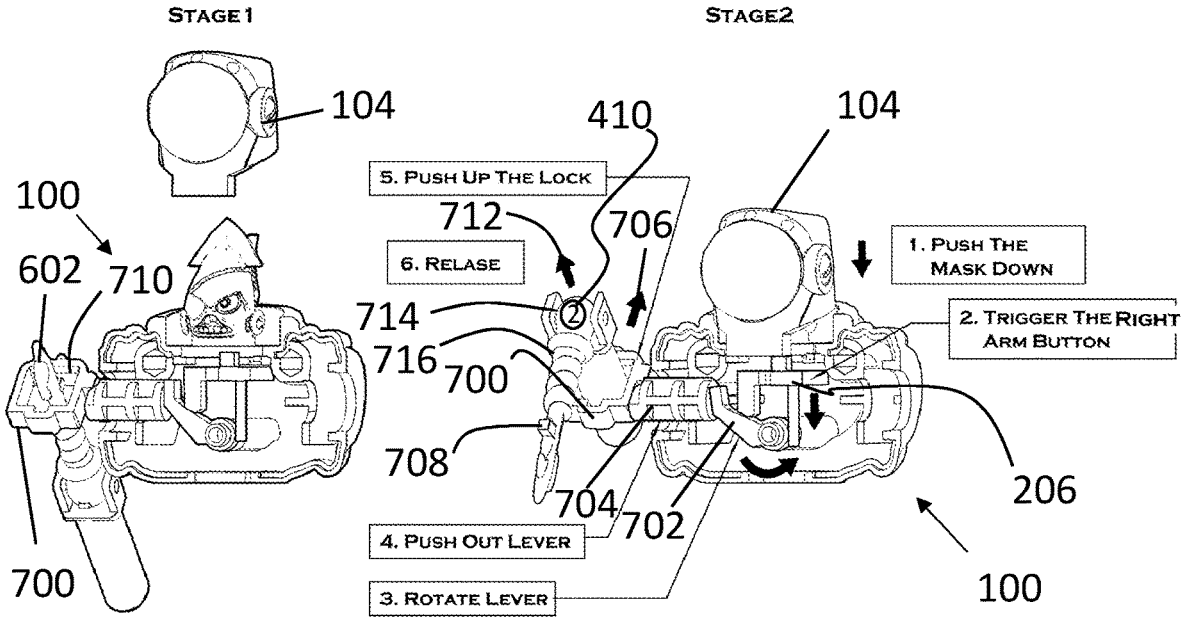
FIG. 7A is a front, interior-view illustration of the toy figure, depicting an interior view of a helmet activated activation mechanism for the second action.
FIG. 7B is a front, interior-view illustration of the toy figure, depicting activation of the helmet activated activation mechanism using the second wearable ring.

As noted above, the toy figure 100 can be formed to perform multiple actions, which are activated based on keying between the user wearable accessory and the activation mechanisms. Another example is depicted in FIGS. 6A through 7B. In this example, the second activation mechanism 600 is positioned within the toy figure 100 and operably transitions between a first stage (show in FIG. 6A) and a second stage (shown in FIG. 6B). Note that the first activation mechanism is removed from the illustration to avoid obstructing imagery of the second activation mechanism 600. Positioning the second ring 104 upon the toy FIG. 100 causes the figure 100 to transition from the first stage (shown in FIG. 6A) to the second stage (shown in FIG. 6B), where the second action is performed (i.e., spring-loaded expanding features 602 on the right arm). The interior, isometric-views of FIGS. 7A and 7B illustrate the process clearly as the toy figure transitions from stage one to stage two of the second action. Initially and as shown in FIG. 7A, the second spring-loaded feature 602 of the second action is locked by a lock 700 within a casing. As shown in FIG. 7B, as the second ring 104 is positioned onto the toy figure 100 as a mask, a marking on the second ring 104 engages with the second button 206 (i.e., right arm button) to push downward the second button 206 and activate the second activation mechanism. Pivotally connected with the toy figure 100 is a second rotate lever 702. Further, slidably positioned within the toy figure 100 is a second push out lever 704 that is formed to slidably engage with the lock 700. Thus, in operation, when the keyed marking on the second ring 104 depresses the second button 206, the second button 206 pushes downward on the second rotate lever 702, which pushes outward the tip of the second rotate lever 702. The second rotate lever 702 in turn pushes out the second push out lever 704. The distal end of the second push out lever 704 is angled such that when it engages with the lock 700, it pushes up 706 the lock 700. Initially, the second spring-loaded feature 602 of the second action was locked within the lock 700 by a tab 708 that was held in place under a lip 710 within the lock 700. As the lock 700 is pushed up 706, the tab 708 is freed from the lip 710 to allow the second spring-loaded feature 602 to be released and expand outward 712. In this non-limiting example, the spring-loaded feature 602 includes a base 714 and a pivotally connected pivot arm 716. Thus, when the base 714 is released and expands outwards 712, the pivotally connected pivot arm 716 is free to rotate downward (via gravity or spring if included) once free of the casing (element 718 in FIG. 6A).

As described above, the distinct wearable accessories are keyed to engage with and cause the toy figure 100 to perform a corresponding action. It should be understood that although the invention is described above with respect to two distinct rings causing the toy figure 100 to perform two different functions, the invention is not intended to be limited thereto. For example, a third distinct ring can be included that is keyed to simultaneously trigger both the first and second activation mechanisms. In other aspects, a third activation mechanism, etc., can also be built into the toy figure 100 and activated by a corresponding wearable accessory that is keyed accordingly. Thus, as can be appreciated, the invention can be expanded to include a variety of additional features.

In another aspect, the toy figure 100 and corresponding wearable accessories (e.g., first ring 102 and second ring 104) can be used in game play between multiple players. For example, individual users may have their own figures and wearable accessories that they use to battle one another. The figures 100 and wearable accessories can be formed with various markings that allow for various levels of attack strength when battling. As a non-limiting example and as shown in FIGS. 4B and 7B, numerals can be included on the toy figure that will appear as small circular stickers 410 hidden somewhere on each weapon. These numbers will only be revealed once the activation happens. The numbers will be used to determine strength of the attack and can be used to determine a winner between two figures whom are "battling" (i.e., the weapon with the highest numerical strength wins, defeating the opponent). To further add to battling and gameplay, the wearable accessories can also be formed to include a hidden symbol. As a non-limiting example and as shown in FIG. 1B, a symbol 120 can be sculpted on the inside of each ring that acts as hidden tie breaker in the event that the weapon strengths are equal when two toy figures are battling one another. The symbols 120 can be provided various tie-breaking rules, similar to the children's game of paper, scissors, rocks. For example, a fire symbol beats a wood symbol, while a water symbol beats a fire symbol, but a wood symbol beats a water symbol. These markings (i.e., symbols, numerals, etc.) and rules can be modified and/or altered as desired and understood by those skilled in the art of role playing and game play.

Given the description above and illustrations as submitted herewith, it should be understand that there are a variety of activation mechanisms and corresponding actions that can be implemented using the concepts of the present invention. Further, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. An action activated toy figure, comprising:

a toy figure having a first activation mechanism, the first activation mechanism having a first trigger that, when activated, causes the first activation mechanism to perform a first action;

a first user wearable accessory, the first user wearable accessory having keyed markings that are keyed to engage with and activate the first trigger.

2. The action activated toy figure as set forth claim 1, wherein the first activation mechanism includes a first spring-loaded feature that is formed to transition from a first stage to an expanded second stage upon activation of the first activation mechanism.

3. The action activated toy figure as set forth claim 2, wherein the toy figure further comprises a second activation mechanism, the second activation mechanism having a second trigger that, when activated, causes the second activation mechanism to perform a second action.

4. The action activated toy figure as set forth claim 3, further comprising a second user wearable accessory, the second user wearable accessory being distinctly keyed to engage with and activate the second trigger and corresponding second activation mechanism while avoiding activation of the first activation mechanism.

5. The action activated toy figure as set forth claim 4, wherein the second activation mechanism includes a second spring-loaded feature that is formed to transition from a first stage to an expanded second stage upon activation of the second activation mechanism.

6. The action activated toy figure as set forth claim 4, wherein each of the first and second user wearable accessories are distinct wearable rings, necklace charms or earrings.

7. The action activated toy figure as set forth claim 4, wherein each of the first and second user wearable accessories are formed to be positioned onto the toy figure as a helmet or mask to at least partially conceal a head of the toy figure, such that upon positioning one of the first or second user wearable accessories onto the toy figure, the keyed marking engages with the corresponding first or second trigger.

8. The action activated toy figure as set forth claim 4, wherein each of the first and second user wearable accessories are formed to be positioned onto the toy figure as a backpack onto the toy figure, the keyed marking engages and activates a feature of the toy figure.

9. The action activated toy figure as set forth claim 4, wherein the second user wearable accessory activates the second trigger by depression of a second button of the toy figure.

10. The action activated toy figure as set forth claim 3, wherein each of the first and second actions include causing the toy figure to reveal a first and second toy weapons, respectively.

11. The action activated toy figure as set forth claim 10, wherein each of the first and second toy weapons have distinct numerical markings thereon.

12. The action activated toy figure as set forth claim 2, wherein the first spring-loaded feature is a spring-loaded and locked activation mechanism such that that the first activation mechanism can be reset and triggered.

13. The action activated toy figure as set forth in claim 2, wherein the first spring-loaded feature is a spring-loaded sword that can be slid and locked into a cavity or sheath within the toy figure.

14. The action activated toy figure as set forth in claim 2, wherein the first spring-loaded feature is a spring-loaded rotatable blade that rotates when triggered.

15. The action activated toy figure as set forth in claim 2, wherein the first spring-loaded feature a spring-loaded shaft such that when engaged a concealed weapon is exposed.

16. The action activated toy figure as set forth claim 1, wherein the first wearable user accessory is a wearable ring, necklace charms or earrings.

17. The action activated toy figure as set forth claim 1, wherein the first wearable user accessory is formed to be positioned onto the toy figure as a helmet or mask to at least partially conceal a head of the toy figure, such that upon positioning the first user wearable accessory onto the toy figure, the keyed marking engages with the corresponding first trigger.

18. The action activated toy figure as set forth claim 1, wherein the first action includes causing the toy figure to reveal a first toy weapon.

19. The action activated toy figure as set forth claim 1, wherein the first toy weapon has a numerical marking thereon.

20. The action activated toy figure as set forth claim 1, wherein the first user wearable accessory activates the first trigger by depression of a first button of the toy figure.

* * * * *